United States Patent [19]

Wassenhoven et al.

[11] Patent Number: 4,901,519

[45] Date of Patent: Feb. 20, 1990

[54] METHOD AND APPARATUS FOR SEPARATING SLIVER INTO INDIVIDUAL FIBERS IN A SLIVER OPENING DEVICE

[75] Inventors: Heinz-Georg Wassenhoven, Moenchengladbach; Karl-Josef Brockmanns, Willich, both of Fed. Rep. of Germany

[73] Assignee: W. Schlafhorst & Co., Fed. Rep. of Germany

[21] Appl. No.: 380,132

[22] Filed: Jul. 14, 1989

[30] Foreign Application Priority Data

Jul. 15, 1988 [DE] Fed. Rep. of Germany ..... 3832984

[51] Int. Cl.[4] ..... D01H 7/895; D01H 7/888; D01G 9/06; D01G 23/00

[52] U.S. Cl. ..... 57/411; 19/97.5; 19/105; 57/301; 57/304; 57/408

[58] Field of Search ..... 57/301, 302, 304, 305, 57/408, 411, 412, 404; 19/97.5, 105, 112

[56] References Cited

U.S. PATENT DOCUMENTS

| | | | |
|---|---|---|---|
| 3,681,907 | 8/1972 | Jinkra et al. | 57/411 |
| 3,763,641 | 10/1973 | Doudlebsky et al. | 57/301 |
| 3,834,145 | 9/1974 | Ellingham et al. | 57/411 X |
| 3,943,690 | 3/1976 | Noguera | 57/411 |
| 4,201,037 | 5/1980 | Artzt et al. | 57/301 |
| 4,676,059 | 6/1987 | Artzt et al. | 57/408 X |
| 4,815,269 | 3/1989 | Wassenhoven | 57/412 |
| 4,825,637 | 5/1989 | Wassenhoven | 57/412 |

FOREIGN PATENT DOCUMENTS

| | | |
|---|---|---|
| 2108254 | 8/1972 | Fed. Rep. of Germany . |
| 2239582 | 2/1973 | Fed. Rep. of Germany . |
| 555418 | 10/1974 | Switzerland . |

*Primary Examiner*—John Petrakes

*Attorney, Agent, or Firm*—Shefte, Pinckney & Sawyer

[57] ABSTRACT

A sliver opening apparatus for separating sliver into individual fibers for feeding of the individual fibers to the rotor of an open end spinning machine includes a rotating opening roller having a hollow interior and perforations from its exterior to its interior and air flow control elements disposed in the hollow interior of the opening roller. The air flow control elements define an opening located generally adjacent the sliver intake opening and an interior hollow chamber extending from the opening, the chamber being relatively large and the opening being relatively small. When the opening roller rotates, the air flow control elements cause the fibers from the incoming sliver to project toward the opening roller for optimum separation and combing by the teeth of the opening roller.

14 Claims, 1 Drawing Sheet

METHOD AND APPARATUS FOR SEPARATING SLIVER INTO INDIVIDUAL FIBERS IN A SLIVER OPENING DEVICE

BACKGROUND OF THE INVENTION

The present invention relates to a method and apparatus for separating sliver into individual fibers in a sliver opening device.

In an open end spinning machine, a sliver opening device separates sliver into individual fibers and feeds them to the rotor of the machine for spinning. One type of sliver opening device includes a rotating opening roller having a circumferential surface with a number of teeth projecting therefrom for combing and separating the sliver into individual fibers. The opening roller is rotatably disposed within a housing and the rotation of the roller creates air flow conditions within the housing which influence the behavior of the sliver fed to the opening roller. For example, the rotating opening roller produces a tangential air flow about its circumference which influences the behavior of the sliver being fed into the housing through the sliver intake opening of the sliver opening device. The sliver is typically fed in a generally inwardly radial direction with respect to the opening roller for action by the teeth in separating individual fibers from the sliver. A radial orientation of the fibers transverse to the direction of movement of the teeth produces a more effective combing and separating of the sliver into individual fibers. However, the tangential air flow created by the rotating opening roller tends to displace the incoming sliver somewhat tangentially out of position for optimum action by the teeth of the opening roller.

Accordingly, the need exists for an apparatus which orients the incoming sliver in a sliver opening device generally radially for optimum engagement by the teeth of the opening roller for separating the sliver into individual fibers.

SUMMARY OF THE INVENTION

The present invention provides an apparatus which orients the incoming sliver in a sliver opening device generally radially for optimum engagement by the teeth of the opening roller for separating the sliver into individual fibers.

Briefly described, the present invention provides a process for separating sliver into individual fibers in a sliver opening device of an open end spinning machine, the sliver opening device being of the type having a sliver intake opening, a trash discharge opening, an outlet opening for the discharge of individual fibers therethrough for feeding to the rotor of the open end spinning machine, a rotating opening roller of the type having a hollow interior and perforations extending from its exterior to its interior and flow control means. The flow control means is disposed in the hollow interior of the opening roller and has an opening located generally adjacent the sliver intake opening and an interior hollow chamber extending from the opening, the chamber being relatively large and the opening being relatively small. The process includes feeding sliver through the sliver intake opening into the sliver opening device and rotating the opening roller, whereby air is caused to move from the exterior of the opening roller interiorly through the opening roller perforations into the hollow interior of the opening roller under the control of the air flow control means to cause fibers from the sliver to project toward the opening roller.

Preferably, the air flow control means includes a second opening located generally adjacent the trash discharge opening and rotating the opening roller causes air to move from the exterior of the opening roller interiorly through the opening roller perforations in the second opening. The process of the present invention preferably includes rotating the opening roller to transport the individual fibers to the outlet opening at which a suction force is applied to the individual fibers sufficient to draw individual fibers to and through the outlet opening, the radially inwardly directed suction forces exerted on the individual fibers by the rotation of the opening roller being insufficient to overcome the force drawing fibers to and through the outlet opening.

The present invention also provides a sliver opening apparatus for separating sliver into individual fibers for feeding of the individual fibers to the rotor of an open end spinning machine. The apparatus includes a housing having a sliver intake opening, a trash discharge opening and a fiber outlet opening for discharge of individual fibers therethrough to the rotor of the open end spinning machine. The apparatus additionally includes an opening roller having an outer surface, a cylindrical inner surface defining a hollow interior and a plurality of perforations extending from its outer surface to its inner surface, and air flow control means, disposed in the hollow interior of the opening roller. The air flow control means has an opening adjacent the sliver intake opening and an interior hollow chamber, the opening being relatively small and the chamber being relatively large.

Preferably, the air flow control means is adjustable to control the size of the opening therein. The air flow control means includes a stationary shutter element and an adjustable shutter element defining the opening adjacent the sliver intake opening. The adjustable shutter element is movable relative to the stationary shutter element to selectively adjust the extent of the opening adjacent the sliver intake opening.

Preferably, the stationary shutter element and the adjustable shutter element are arcuate and extend closely adjacent the opening roller cylindrical inner surface. The air flow control means preferably additionally includes a base portion extending partially under and in closed relation to the adjustable shutter element to permit adjustment of the adjustable shutter element without separation from the base portion.

The perforations in the opening roller are forwardly outwardly inclined in the direction of rotation of the opening roller to create an inward air flow therethrough. Preferably, the air flow control means includes a second opening located generally adjacent the trash discharge opening, the second opening being relatively small relative to the chamber. The air flow control means includes a stationary shutter element and an adjustable shutter element defining the second opening, the adjustable shutter element being movable relative to the stationary shutter element to selectively adjust the extent of the second opening.

DETAILED DESCRIPTION OF THE PREFERRED EMBODIMENT

Figure 1:
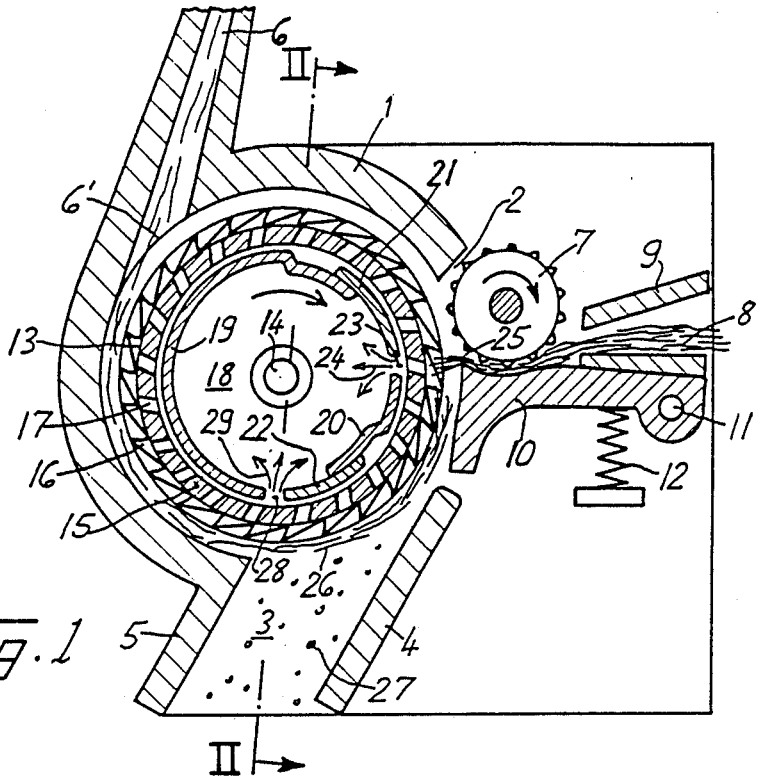
FIG. 1 is a vertical sectional view of a sliver opening device incorporating the preferred embodiment of the present invention.
Figure 2:
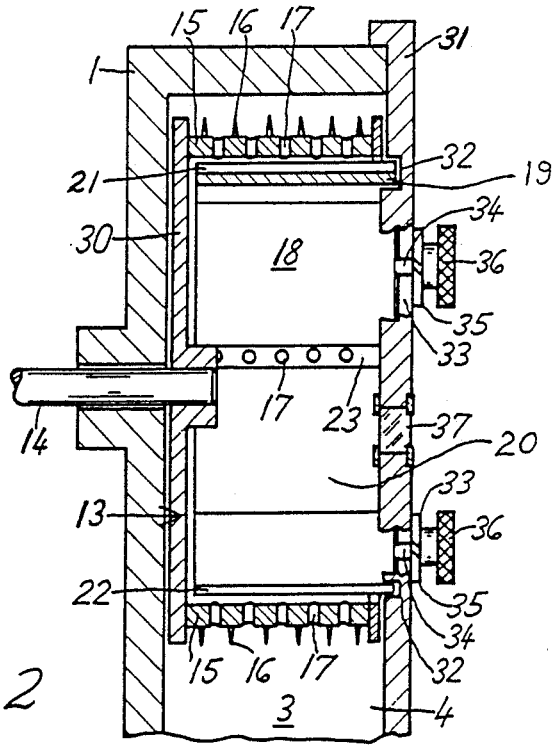
FIG. 2 is a vertical sectional view of the sliver opening device shown in FIG. 1, as viewed along line A-A thereof.

In FIGS. 1 and 2, the preferred embodiment of the sliver opening device of the present invention is illustrated. The sliver opening device is adapted for use with an open end spinning machine and includes a housing 1, a sliver intake opening 2 for the feeding of sliver into the housing 1 for separation of the sliver into individual fibers, and a trash discharge opening 3 defined by a pair of opposed walls 4 and 5 integrally formed with the housing 1. The sliver opening device additionally includes an outlet opening 6' for passage of separated fibers therethrough into a conduit 6 leading from the sliver opening device to the rotor of the open end spinning machine.

The sliver opening device additionally includes a feed roller 7, a feed arm 10 pivotable about a pivot point 11, and a spring assembly 12, all of which cooperate with one another in conventional manner to feed a sliver 8 through the sliver intake opening 2. The spring assembly 12 biases the free arm of the feed arm 10 toward the feed roller 7 and the feed arm 10 pivots against the bias of the spring assembly 12 in correspondence with changes in the characteristics of the sliver 8. For example, as the thickness of the sliver 8 increases, the feed arm 10 pivots away from the feed roller 7 against the bias of the spring assembly 12 to accommodate passage of the thicker sliver.

The sliver opening device also includes an opening roller 13 supported for rotation within the housing 1 and an air flow control means. As best seen in FIG. 2, the opening roller 13 includes an axle 14 rotatably supported by the housing 1 and a cylindrical member 15 defining a hollow interior 18 therein. The cylindrical member 15 of the opening roller 13 is provided with a plurality of angled teeth 16 on its outer surface. Additionally, a plurality of perforations 17 extend through the cylindrical member 15 from the exterior of the opening roller to its hollow interior 18. The opening roller 13 also includes a side plate 30 having a central through-bore in which the axle 14 of the opening roller 13 is fixedly mounted. In the operating position of the opening roller 13 within the housing 1, the axial end of the cylindrical member 15 which is remote from the side plate 30 is in closely adjacent relation to the cover 31 of the housing 1.

The air flow control means includes a pair of stationary shutter elements 19, 20 and a pair of adjustable shutter elements 21, 22, for controlling the flow of air through the perforations 17 of the opening roller 13 during rotation thereof. The stationary shutter element 19 forms a base portion having a first arcuate extent with an outer radius slightly smaller than the inner radius of the opening roller 13 and positioned closely adjacent the inner circumference of the opening roller 13 and a second arcuate extent of reduced outer radius. Similarly, the other stationary shutter element 20 includes a base portion having a first arcuate extent having an outer radius slightly smaller than the inner radius of the opening roller 13 and positioned closely adjacent thereto and a second arcuate extent of reduced outer radius. The stationary shutter elements 19, 20 are each fixedly secured along one respective arcuate side edge to the cover 31 that covers one axial end of the housing 1.

The adjustable shutter 21 is arcuately shaped with an outer radius slightly smaller than the inner radius of the opening roller 13 and an inner radius slightly greater than the second arcuate extent of the stationary shutter 19. The adjustable shutter element 21 is adjustably mounted within the hollow interior 18 of the opening roller 13 with its outer arcuate surface closely adjacent the inner circumference of the opening roller 13. The other adjustable shutter element 22 is arcuately shaped with an outer radius slightly smaller than the inner radius of the opening roller and an inner radius slightly greater than the second arcuate portion of the stationary shutter element 20. As best seen in FIG. 2, each adjustable shutter element 21, 22 extends perpendicular to the cover 31 of the housing 1 and one arcuate side edge thereof is received in a respective one of a pair of arcuate slots 32 formed on the interior of the cover 31. A stem 34 is fixedly mounted to each adjustable shutter 21, 22 and projects therefrom through a respective one of a pair of arcuate through-bores 33 extending through the cover 31. The free end of each stem 34 extends outwardly beyond the cover 31 and is threaded for threadably receiving a nut 36 thereon. A lock washer 35 is inserted over each stem 34 and disposed between the nut 36 and the cover 31.

Each adjustable shutter element 21, 22 is adjustably positionable relative to the housing 1 and the opening roller 13 through selective loosening and tightening of the nut 36 threaded on its respective stem 34. To fixedly secure each adjustable shutter element 21, 22 in a selected position relative to the cover 31 of the housing 1, the nut 36 is threaded along the stem 34 toward its associated adjustable shutter element to a position in which the nut 36 presses its associated lock washer 35 against the outside of the cover 31 while the adjacent arcuate side edge of the adjustable shutter element 21, 22 presses against the inside of the cover 31. By unthreading the nut 36 along the stem 34, the stem 34 is released to be adjustably moved along the arcuate through-bore 33 in which it is received. The movement of each stem 34 in its arcuate through-bore 33 produces movement of the associated adjustable shutter element 21, 22 in a concentric direction with respect to the inner cylindrical surface of the opening roller 13. When each adjustable shutter element 21, 22 has been adjustably re-positioned, its respective nut 36 can be threaded along its associated stem 34 to fixedly secure the adjustable shutter element in its new position.

As best seen in FIG. 1, the adjustable shutter element 21 has an arcuate extent slightly greater than the arcuate spacing defined between one pair of adjacent end portions of the stationary shutter element 19 and the other stationary shutter element 20. Thus, the adjustable shutter element 21 slightly overlaps the second arcuate extent of the stationary shutter element 19 throughout the range of movement of the adjustable shutter element 21 arcuately along the arcuate slot 32. By selective movement of the adjustable shutter element 21 toward the stationary shutter element 20, the size of the opening 23 defined therebetween is adjustably increased or decreased. As best seen in FIG. 2, the opening 23 has a longitudinal extent extending parallel to the axle 14 of the opening roller 13 and a lateral extent extending transversely to its longitudinal extent which increases or decreases in correspondence with the movement of the adjustable shutter element 21 relative to the stationary shutter element 20. As best seen in FIG. 1, the opening 23 is located generally adjacent the sliver feed opening 2. The opening 23 opens interiorly of the stationary shutter 20 and the adjustable shutter element 21 into a hollow chamber which is relatively much larger than the opening 23.

Similarly, the adjustable shutter element 22 has an arcuate extent slightly greater than the arcuate spacing between the other pair of adjacent end portions of the stationary shutter elements 19, 20 such that the adjustable shutter element 22 continuously overlaps the second arcuate extent of the stationary shutter element 20 throughout the range of movement of the adjustable shutter element 22 arcuately along the arcuate slot 32. By selective movement of the adjustable shutter element 22, the size of a second opening 28 defined between the stationary shutter element 19 and the adjustable shutter element 22 is correspondingly increased or decreased.

The sliver opening device additionally includes a window 37 formed of a clear material such as glass which is fixedly mounted in a through-bore extending through the cover 31.

In accordance with the present invention, the sliver 8 is fed into the sliver opening device for separation of the sliver into individual fibers and for removal of trash entrained in the sliver. The sliver intake roller 7 is operated in conventional manner to rotate in the direction of the arrow shown in FIG. 1 to continuously feed the sliver 8 through the sliver intake opening 2 into the housing 10. During feeding of the sliver 8 into the housing 1, the opening roller 13 is rotated in the direction as shown by the arrow in FIG. 1. In accordance with the present invention, a turbine effect is created by the rotation of the opening roller 13 relative to the stationary shutter elements 19, 20 and the adjustable shutter elements 21, 22. Specifically, the perforations 17 of the cylindrical member 15 of the opening roller 13 are inclined outwardly forwardly with respect to the direction of rotation of the opening roller 13. Accordingly, the perforations 17 direct air inwardly from the exterior of the opening roller 13 into its hollow interior 18 as the opening roller rotates. To optimally orient the incoming sliver 8 for efficient separation of the sliver into individual fibers by the teeth 16 of the opening roller 13, the adjustable shutter element 21 is selectively positioned to control the size of the opening 23 such that the air being directed inwardly by the perforations 17 moves through the opening 23 in an air flow indicated by the arrows 24. The air flow 24 is a flow of air moving generally radially inwardly of the opening roller 13 and the magnitude of the air flow is controllable by selectively increasing or decreasing the lateral extent of the opening 23.

Experience has shown that the opening roller 13 can most effectively engage and separate the incoming sliver 8 into individual fibers if the incoming sliver is oriented generally radially with respect to the opening roller 13 or, in other words, oriented generally transversely to the direction of rotation of the angled teeth 16 of the opening roller 13. Accordingly, the adjustable shutter element 21 is selectively positioned to control the air flow 24 to exert a generally radially inward flow of air from the exterior of the opening roller 13 to its hollow interior 18. The inwardly moving air flow urges the incoming sliver 8 into a generally radial orientation transverse to the direction of the rotation of the opening roller teeth 16 in a so-called fiber beard 25 for efficient opening and separating of the sliver into individual fibers.

The rotation of the opening roller 13 also produces a tangential force which urges the fibers of the incoming sliver 8 to align themselves in directions generally tangential with respect to the opening roller 13. However, through appropriate adjustment of the opening 23 to control the magnitude of the air flow 24, the air flow 24 can exert a radially inwardly directed force on the fibers of the incoming sliver 8 sufficient to overcome the tangential force created by the opening roller 13, whereby the fibers are aligned generally radially with respect to the opening roller for optimum engagement by the angled teeth thereof.

Once the incoming sliver 8 is separated into individual fibers, the fibers are aligned by the tangential air flow created by the rotating opening roller 13 in directions generally tangential to the opening roller and are carried by the air flow between the opening roller 13 and the housing 1 toward the outlet opening 6, As the tangentially aligned, separated fibers 26 are transported in the vicinity of the trash discharge opening 3, the trash 27 entrained therewith, which tends to be of a greater mass than the individual fibers themselves, moves under the operation of centrifugal force outwardly from the opening roller 13 to be guided between the walls 4, 5 of the housing 1 toward a trash collection location (not shown). Since the trash 27 has a greater mass than the individual fibers 26, the tangential acceleration of the trash 27 is greater than that of the fibers 26 and the trash therefore moves tangentially outwardly from the opening roller 13 through the trash discharge opening 3. In accordance with a further aspect of the present invention, the separation of the trash 27 from the individual fibers 26 and retention of the fibers for passage past the trash opening to the outlet opening 6, is facilitated by a radially inwardly directed air flow exerted on the individual fibers 26 as they pass in the vicinity of the trash outlet opening 3. The radially inwardly directed force on the individual fibers 26 is created due to an air flow 29 through the second opening 28 and urges the individual fibers inwardly against the cylindrical member 15 of the opening roller 13. Specifically, the adjustable shutter element 22 is selectively positioned relative to the stationary shutter element 19 to control the lateral extent of the opening 28 for controlling the radially inwardly directed air flow 29. The magnitude of the radially inwardly directed air flow 29 is sufficient to urge the individual fibers 26 radially inwardly against the cylindrical member 15 yet insufficient to overcome the tendency of the heavier mass trash 27 to move radially outwardly through the outlet opening 3.

The stationary shutter element 19 is formed without any openings in the vicinity of the outlet opening 6′ so that no radially inwardly directed force is created at that location which might counteract the suction force applied through the outlet conduit 6. Accordingly, the individual fibers 26 readily pass through the outlet opening 6′ under the influence of the suction applied through the outlet conduit 6 and are thereafter transported to the rotor for open end spinning. Additionally, the relative positioning of the stationary shutter elements 19, 20 and the adjustable shutter elements 21, 22 relative to one another insures that the radially inwardly directed air flows are created only at the desired locations, such as the sliver intake opening 2 and the trash discharge opening 3.

Following several cycles of operation, the sliver opening device eventually experiences a build up of trash, dust and other debris therein which is preferably to be removed to maintain efficient operation of the device. The accumulation of debris in the sliver opening device occurs, for example, through the deposit of fine pieces of fiber which come loose from the individual fibers. To this end, the sliver opening device of the present invention includes the window 37 for monitoring the build-up of debris within the housing 1, such as, for example, by manual inspection of the interior or through optical sensing by optical sensors. Upon determining that the sliver opening device should be cleaned, the cover 31 can be removed to expose the hollow interior 18 of the opening roller and the stationary shutter elements 19, 20, the adjustable shutter elements 21, 22, the opening roller 13 and the housing 1 can be cleaned by an appropriate cleaning device. Alternatively, the sliver opening device can be cleaned during regularly scheduled cleaning periods or at the end of each spinning cycle.

As can be understood, the turbine effect created by the cooperative operation of the perforations 17 with the openings 23, 29 can be controlled through adjustment of the size and location of the openings and the size and inclinations of the perforations 17.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A process for separating sliver into individual fibers in a sliver opening device of an open end spinning machine, the sliver opening device being of the type having a sliver intake opening, a trash discharge opening, an outlet opening for the discharge of individual fibers therethrough for feeding to the rotor of the open end spinning machine, a rotating opening roller of the type having a hollow interior and perforations extending from its exterior to its interior, and air flow control means disposed in the hollow interior of the opening roller having an opening located generally adjacent the sliver intake opening and an interior hollow chamber extending from the opening, the chamber being relatively large and the opening being relatively small, comprising:

feeding sliver through the sliver intake opening into the sliver opening device; and rotating the opening roller, whereby air is caused to move from the exterior of the opening roller interiorly through the opening roller perforations into the hollow interior of the opening roller under the control of said air flow control means to cause fibers from the sliver to project toward the opening roller.

2. A process according to claim 1 and characterized further in that the air flow control means includes a second opening located generally adjacent the trash discharge opening and said rotating the opening roller causes air to move from the exterior of the opening roller interiorly through the opening roller perforations and the second opening, whereby the flow of air through the second opening of the air flow control means is sufficient to urge the individual fibers radially inwardly with respect to the opening roller against the opening roller while being insufficient to divert trash entrained with the individual fiber from movement toward the trash discharge opening.

3. A process according to claim 1 and characterized further in that said rotating the opening roller includes rotating the opening roller to transport the individual fibers to the outlet opening at which a suction force is applied to the individual fibers sufficient to draw individual fibers to and through the outlet opening, the radially inwardly directed suction forces exerted on the individual fibers by the rotation of the opening roller being insufficient to overcome the force drawing fibers to and through the outlet opening.

4. A sliver opening apparatus for separating sliver into individual fibers for feeding of the individual fibers to the rotor of an open end spinning machine, comprising:

a housing having a sliver intake opening, a trash discharge opening and a fiber outlet opening for discharge of individual fibers therethrough to the rotor of the open end spinning machine;

an opening roller having an outer surface, a cylindrical inner surface defining a hollow interior and a plurality of perforations extending from its outer surface to its inner surface; and air flow control means, disposed in said hollow interior of said opening roller, said control means having an opening adjacent said sliver intake opening and an interior hollow chamber, said opening being relatively small and said chamber being relatively large.

5. A sliver opening apparatus according to claim 4 and characterized further in that said control means is adjustable to control the size of said opening therein.

6. A sliver opening apparatus according to claim 4 and characterized further in that said control means includes a stationary shutter element and an adjustable shutter element defining said opening adjacent said sliver intake opening, said adjustable shutter element being movable relative to said stationary shutter element to selectively adjust the extent of said opening adjacent said sliver intake opening.

7. A sliver opening apparatus according to claim 6 and characterized further in that said stationary shutter element and said adjustable shutter element are arcuate and extend closely adjacent said opening roller cylindrical inner surface.

8. A sliver opening apparatus according to claim 7 and characterized further in that said control means includes a base portion extending partially under and in closed relation to said adjustable shutter element to permit adjustment of said adjustable shutter element without separation from said base portion.

9. A sliver opening apparatus according to claim 4 and characterized further in that said perforations are inclined outwardly in the direction of rotation of said opening roller to create an inward air flow therethrough.

10. A sliver opening apparatus according to claim 4 and characterized further in that said air flow control means includes a second opening located generally adjacent said trash discharge opening, said second opening being relatively small relative to said chamber.

11. A sliver opening apparatus according to claim 10 and characterized further in that said air flow control means is adjustable to control the size of said second opening.

12. A sliver opening apparatus according to claim 11 and characterized further in that said control means includes a stationary shutter element and an adjustable shutter element defining said second opening, said adjustable shutter element being movable relative to said stationary shutter element to selectively adjust the extent of said second opening.

13. A sliver opening apparatus according to claim 12 and characterized further in that said stationary shutter element and said adjustable shutter element are arcuate and extend closely adjacent said opening roller cylindrical inner surface.

14. A sliver opening apparatus according to claim 13 and characterized further in that said control means includes a base portion extending partially under and in closed relation to said adjustable shutter element to permit adjustment of said adjustable shutter element without separation from said base portion.

* * * * *